US006941103B2

(12) United States Patent
Schlien

(10) Patent No.: US 6,941,103 B2
(45) Date of Patent: Sep. 6, 2005

(54) RELEASE AGENT MANAGEMENT SYSTEM WITH ANILOX ROLLER

(75) Inventor: Ruediger Schlien, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 74 days.

(21) Appl. No.: 10/625,638

(22) Filed: Jul. 23, 2003

(65) Prior Publication Data

US 2004/0105707 A1 Jun. 3, 2004

Related U.S. Application Data

(60) Provisional application No. 60/420,047, filed on Oct. 21, 2002.

(51) Int. Cl.[7] ..... G03G 15/20
(52) U.S. Cl. ..... 399/325
(58) Field of Search ..... 399/325, 324

(56) References Cited

U.S. PATENT DOCUMENTS

| | | | | |
|---|---|---|---|---|
| 4,301,730 A | * 11/1981 | Heurich et al. | ..... | 101/348 |
| 4,603,634 A | 8/1986 | Fadner | ..... | 101/426 |
| 4,615,295 A | 10/1986 | Wittkopf | ..... | 118/261 |
| 5,416,298 A | 5/1995 | Roberts | ..... | 219/121.68 |
| 5,597,413 A | 1/1997 | Kromm, Jr. | ..... | 118/60 |
| 5,908,505 A | 6/1999 | Bargenquest et al. | ..... | 118/211 |
| 6,431,066 B1 | 8/2002 | Perez et al. | ..... | 101/350.6 |
| 2001/0025468 A1 | 10/2001 | Brollier et al. | ..... | 53/426 |

FOREIGN PATENT DOCUMENTS

| | | | | |
|---|---|---|---|---|
| JP | 10333478 A | * 12/1998 | ..... | G03G/15/20 |
| JP | 11038814 A | * 2/1999 | ..... | G03G/15/20 |
| JP | 11249475 A | * 9/1999 | ..... | G03G/15/20 |
| JP | 2001034106 A | * 2/2001 | ..... | G03G/15/20 |

* cited by examiner

*Primary Examiner*—Quana Grainger
(74) *Attorney, Agent, or Firm*—Lawrence P. Kessler

(57) ABSTRACT

A reproduction apparatus having a station for fusing images to a receiver sheet with a heated fuser roller has a release agent management system that uses an anilox roller. The anilox roller is made of metal or ceramic or other material and has a number of metering cells for holding release agent material. A doctor blade wipes excess material from the anilox roller and a donor roller picks up the metered amounts of release agent and applies the release agent to the heated fuser roller. The release agent prevents offset of the image to the fuser roller and promotes the easy separation of a receiver sheet from the fuser roller.

10 Claims, 5 Drawing Sheets

RELEASE AGENT MANAGEMENT SYSTEM WITH ANILOX ROLLER

This application claims the benefit of provisional application Ser. No. 60/420,047, filed Oct. 21, 2002.

FIELD OF THE INVENTION

The present invention relates to a fuser apparatus for electrostatographic printing machines and in particular to release agent management systems for a heat and pressure roller fuser.

BACKGROUND OF THE INVENTION

In imaging systems commonly used today, a charge retentive surface on a charge retentive member is typically charged to a uniform potential and thereafter exposed to a light source to selectively discharge the charge retentive surface and form a latent electrostatic image thereon. The latent image may comprise either the discharged portions or the charged portions of the charge retentive surface. The light source may comprise any well known device such as a light lens scanning system, a laser beam or an array of LEDs. Subsequently, the electrostatic latent image on the charge retentive surface is rendered visible by developing the image with developer powder. The most common development systems employ developer powder which includes both charged carrier particles and charged toner particles which triboelectrically adhere to the carrier particles. During development, the toner particles are attracted from the carrier particles by the charged pattern of the image areas of the charge retentive surface to form a powder image thereon. The developed toner image is transferred to a support surface on a receiver sheet such as a plain paper sheet to which it may be permanently affixed by heating or by the application of pressure or a combination of both.

In order to fix or permanently fuse the toner material onto the receiver sheet by heat, it is necessary to elevate the temperature of the toner material to a point at which constituents of the toner material coalesce and become tacky. This action causes the toner to flow to some extent onto the fibers or pores of the receiver sheet or otherwise upon the surfaces thereof. Thereafter, as toner material cools, solidification of the toner material occurs causing the toner material to be bonded firmly to the receiver sheet.

One approach to thermal fusing of toner material images onto the receiver sheet has been to pass the substrate with the unfused toner images thereon between a pair of opposed roller members at least one of which, called the fuser roll, is heated. During operation of a fusing system of this type, the receiver sheet to which the toner images are electrostatically adhered is moved through the nip formed between the rolls with the toner image contacting the heated fuser roll thereby effecting the heating of the toner images within the nip. Such fusing devices typically comprise two rollers wherein the fusing roller is coated with an abhesive material, such as a silicone rubber or other low surface energy elastomer or, for example, tetrafluoroethylene resin sold by E.I. duPont de Nemours and Company under the trademark TEFLON®. In these fusing systems, however, since the toner image is tackified by heat, a part of the image carried on the surface of the fuser roll adheres to the fuser roll and is offset either to a subsequent receiver sheet or to the pressure roll when there is no sheet passing through a fuser nip. Both types of offset may contaminate the pressure roll with subsequent offset of toner from the pressure roll to the image substrate.

To solve the foregoing toner offset problem it has been common practice to utilize toner release agents such as silicone oil, in particular polydimethyl silicone oil, which is applied to the fuser roll surface to a thickness of the order of about one micron to act as a toner release material. Such release agent materials possess a relatively low surface energy and have been found suitable for use in the heated fuser roll environment. In practice, a thin layer of silicone oil is applied to the surface of the heated roller to form an interface between the roller surface and the toner image carried on the support material. This provides a surface with a low surface energy that is easily parted from the toner when the toner passes through the fuser nip and thereby prevents toner from adhering to the fuser roll.

Various systems have been used to deliver release agent fluid to the roll. Such systems incorporate oil soaked rolls and wicks with and without supply sumps as well as oil impregnated webs. Another type of release agent management system holds release agent material in a sump from which it is dispensed using a metering roll and a donor roll, the former of which contacts the release agent material and the latter of which contacts the surface of the heated fuser roll. As such, the problem to be solved is the delivery of release oil in carefully measured amounts to the fuser roller so that the release agent oil delivered is sufficient to release the toner from the fuser roller yet not so much as to carry over to the receiver sheet.

SUMMARY OF THE INVENTION

It is conventional practice to use a metering roller/donor roller release agent management system to apply release agent onto a fuser roller. However, especially in the high quality digital color printing process, a well controlled, relatively high and uniform release agent rate is critical to a high print quality. With conventional metering roller/donor roller release agent management systems, it is very difficult to control those factors. To address this problem, the invention uses an anilox roller as a metering roller. As a result, the invention's release agent rate (amount of agent, which the release agent management system delivers) is very well controlled, the release agent rate is independent from the release agent viscosity, and the release agent film is very uniform.

In the printing industry, anilox rollers are used to supply precise amounts of ink to printing rollers. The invention uses the metering property of anilox rollers for an opposite purpose. Instead of applying ink to a sheet, the invention uses anilox rollers to apply release agent to prevent unwanted markings on a receiver sheet. In the invention, the release agent transferred using the anilox roller prevents unwanted toner particles from transferring to receiver sheets.

Anilox rollers have surfaces with a plurality of metering cells. These cells are small indentations arrayed in regular patterns of a predetermined frequency and of uniform depth and shape. Typically they are created by engraving the cylinder face by a mechanical process or by laser. The cylinder coating typically consists of a very hard material like ceramic or chrome. The invention uses the anilox roller metering cells as release agent metering cells. The amount of release agent delivered by the anilox roll is controlled by the screen size of the cells, which can be very precisely controlled in manufacture. By adjusting the shapes and sizes of the metering cells, anilox metering rollers can be produced for a wide range of release agent rates and viscosities. A technical advantage of the invention is its ability to deliver precisely-measured amount of release agent to the fuser roller so that just enough release agent is provided to release the toner particles without contaminating receiver sheets with release oil.

DETAILED DESCRIPTION OF THE INVENTION

Figure 1:
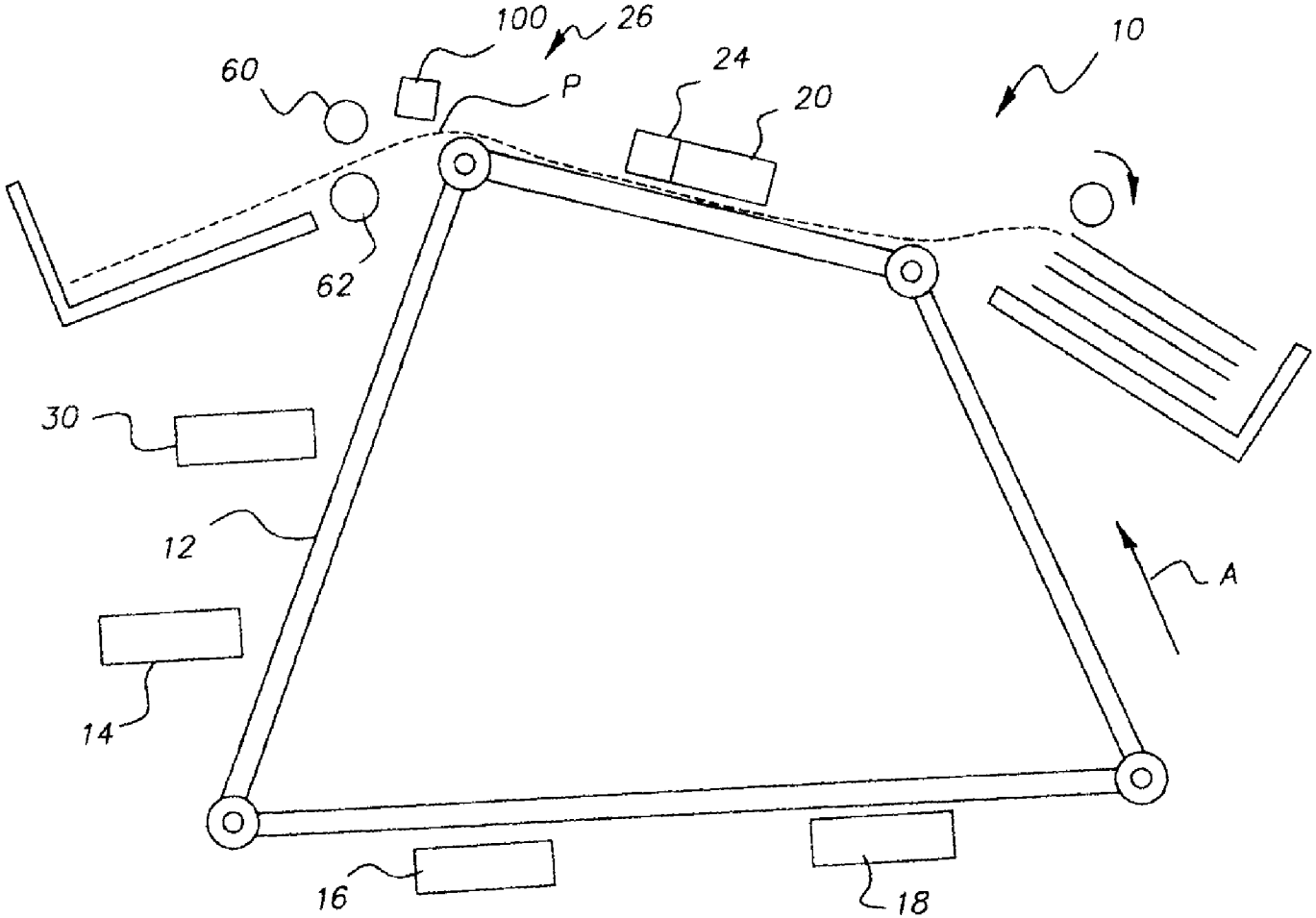
FIG. 1 is a schematic view of an electrostatographic machine.

Referring now to the accompanying drawings, FIG. 1 schematically illustrates a typical reproduction apparatus 10, of the electrophotographic type, suitable for utilizing an exemplary roller transfer assembly such as shown and described in U.S. Pat. No. 6,097,913, whose entire disclosure is incorporated by reference. The reproduction apparatus 10, described herein only to the extent necessary for a complete understanding of this invention, includes a charge retentive dielectric member 12. The dielectric member 12 is, for example, in the form of an elongated endless web mounted on support rollers and movable about a closed loop path through a series of electrographic process stations in the direction of the arrow A.

In the reproduction cycle for the reproduction apparatus 10, the moving charge retentive member 12 is uniformly charged as it moves past a charging station 14. Thereafter the uniformly charged dielectric member 12 passes through an exposure station 16 where the uniform charge is altered to form a latent image charge pattern corresponding to information desired to be reproduced. Depending upon the characteristics of the charge member 12 and the overall reproduction system, formation of the latent image charge pattern may be accomplished by exposing the charge member 12 to a reflected light image of an original document to be reproduced or "writing" on the member 12 with a series of lamps (e.g., LED's or lasers) or point electrodes activated by electronically generated signals based on the desired information to be reproduced. The latent image charge pattern on the member 12 is then brought into association with a development station 18 which applies pigmented marking (toner) particles to adhere to the member 12 to develop that latent image. A receiver sheet supply hopper 22 is located in association with the path P. A receiver sheet 8 is withdrawn from the hopper 22 and is registered with relation to the developed image on the member 12. An electric field produced in the transfer station 20 attracts the marking particles of the developed image from the dielectric member 12 to the receiver member 8.

The electric transfer field may also cause the receiver member 8 to adhere to the dielectric member 12. Accordingly, a detack mechanism 24, immediately downstream in the direction of travel of the dielectric member, is provided to facilitate removal of the receiver member 8 from the dielectric member 12. The detack mechanism 24 may be, for example, an AC corona charger for neutralizing the attractive field holding the receiver member to the dielectric member. After the developed image is transferred to the receiver member 8 and the receiver member 8 is separated from the dielectric member 12, the receiver member 8 is transported through a fusing device 26 where the image is fixed to the receiver member 8 by heat and/or pressure for example, and delivered to an output hopper 28 for operator retrieval. Simultaneously, the dielectric member 12 is cleaned of any residual marking particles at cleaning station 30 and returned to the charging station 14 for reuse.

The fusing station 26 includes a pressure roller 60 and a fuser roller 62. The receiver sheet 8 passes through the nip between the pressure roller 60 and the fuser roller 62. The toner material carried by the receiver sheet is then permanently fixed to the surface of the receiver sheet 8 by the temperature and pressure provided by the pressure roller 60 and the fuser roller 62. As discussed above, fusing stations of the described type are prone to toner particle offset and utilize a release oil to substantially prevent such offset.

Figure 2:
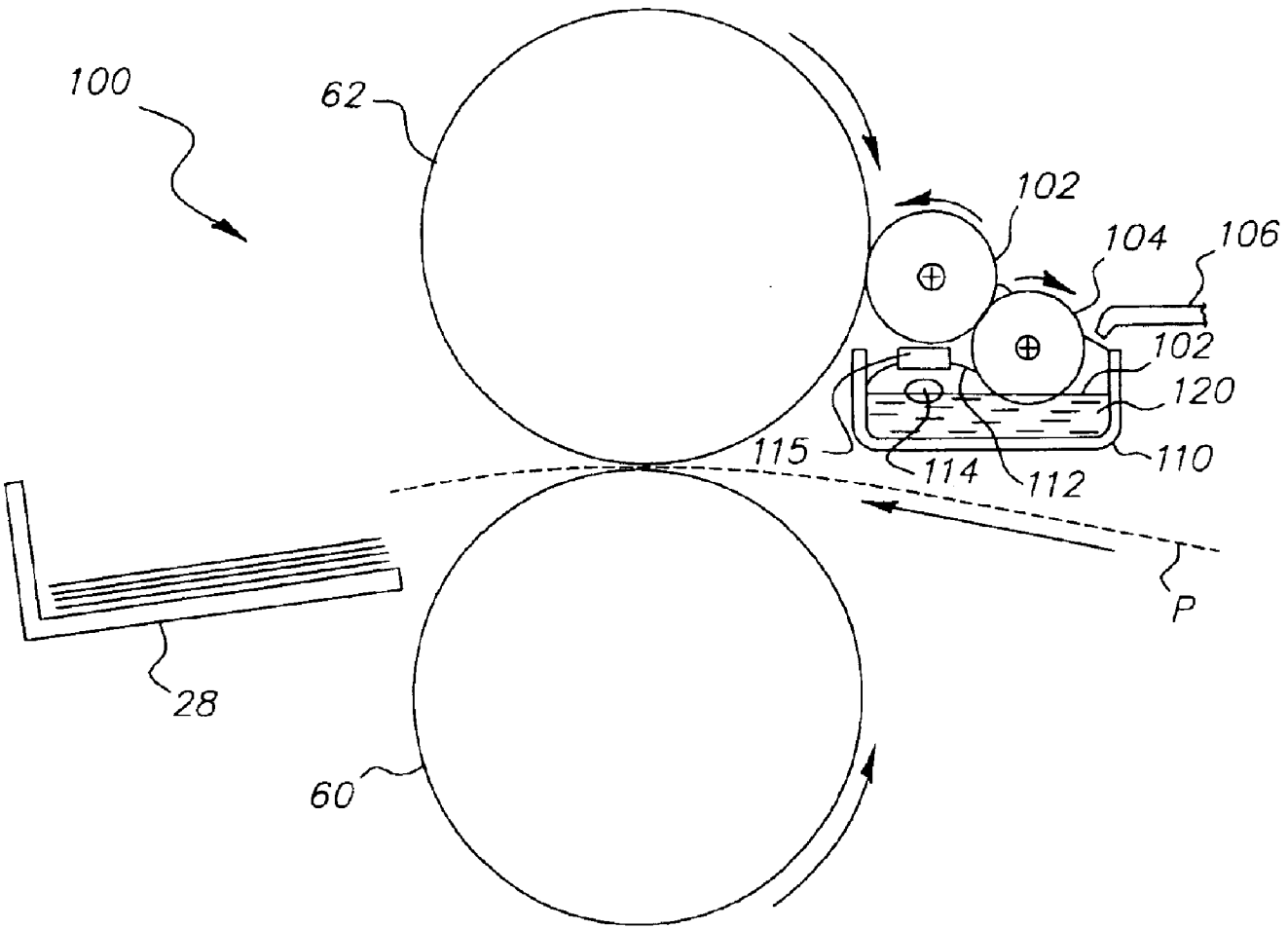
FIG. 2 is a schematic view of a release agent management system with a single doctor blade.

Turning to FIG. 2, there is shown in more detail the release agent management metering station 100 that applies release agent to the fusing roller 62. Of course, in other suitable arrangements, the release agent management metering station can be associated with the pressure roller 60. The metering station 100 includes a reservoir 110 that holds a supply of release agent oil 120. The oil is supplied to the reservoir 110 via an oil supply conduit 106. The housing 110 is provided with an overflow discharge opening 114 in order to keep the level 108 of the release oil 120 within a relatively constant range.

An anilox metering roller 104 has at least a portion of its surface immersed in the release oil 120. The anilox roller 104 may be any one of the conventional type anilox rollers. Its primary characteristic is that its surface includes a plurality of metering cavities that take up precise quantities of the release agent 120 as the surface of the anilox roller 104 passes through the release agent 120. As the surface of the anilox roller leaves the release agent 120, the amount of release agent is further controlled by the doctor blade 112. Doctor blade 112 is held in place by a doctor blade holder 116. The doctor blade 112 wipes off any excess release agent from the anilox roller 104.

The invention may be practiced with a single doctor blade in a first embodiment, or with a pair of doctor blades in a second embodiment. The single blade is oriented in a direction opposed to the travel of the roller. When two blades are used, one is directed opposed to and one in the direction of travel. The one in the direction of travel is the leading blade. See U.S. Pat. Nos. 4,615,295 and 6,431,066 whose entire disclosures are incorporated by reference.

Specifically, well known anilox rollers may include a roller or cylinder core that carries a ceramic or metal layer of wear-resistant material. This layer is engraved to receive a release agent accepting material. Initially, in preparing the anilox roller, the release agent accepting layer is applied, with excess, on the roller which already carries the engraved layer of ceramic or metal wear-resistant material. The excess material of the release agent accepting layer is then removed until the outer surfaces of the ribs of the wear-resistant material are exposed. The receptor depressions or cells are then placed or formed in the oil accepting layer between the freed ribs. Engraving the wear-resistant layer to form the cells leaving the ribs is carried out by a laser for example. Anilox rolls may be chrome rolls or ceramic-coated rolls. The metering cells may be on the order of 400 cells per inch (cpi) or as high as 1200 cpi. Many are in the range of between 1,000 to 1,200 cpi.

Figure 3:
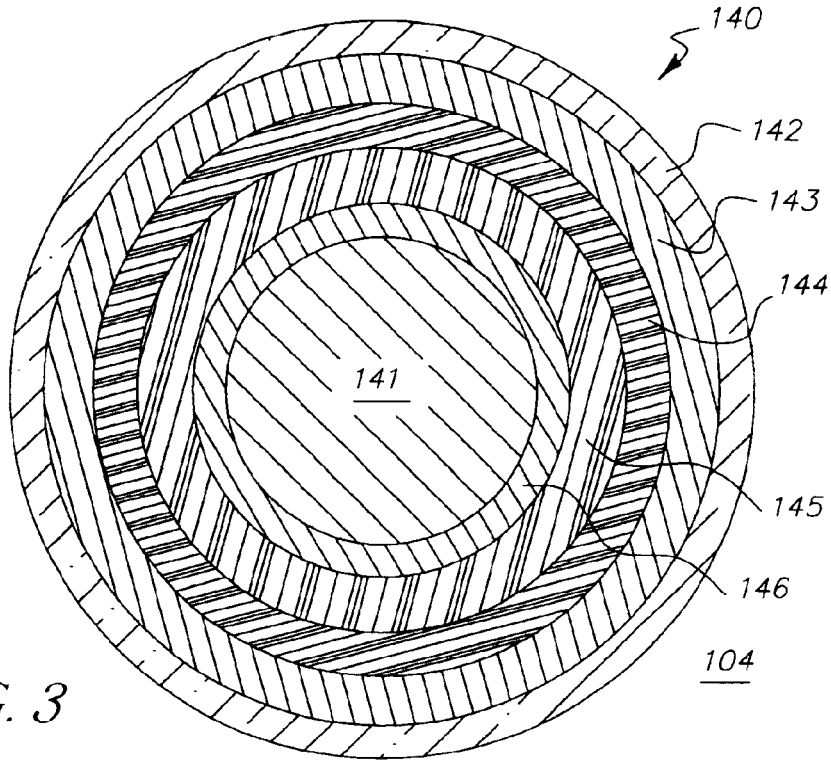
FIG. 3 is a cross sectional view of an anilox roller.

One type of anilox roller 104 includes a number of sleeves that are mounted on a carrier roller. Turing to FIG. 3, a well known anilox sleeve 140 has five layers or concentric sleeves. The outer layer is a ceramic layer 142 that has been exposed to a laser that ablated ceramic material from the outer surface of the layer 142. The ceramic sleeve 142 has a plurality of cellular cavities on its surface. These cavities are described in more detail below. An aluminum sleeve 143 supports the ceramic sleeve 142. Beneath the aluminum sleeve are three support sleeves including an expanded polymer layer 144, a compressible membrane 145 and a composite inner sleeve 146. The sleeve 140 is carried on a roller 141 of aluminum, steel, or carbon fiber.

Figure 4A:
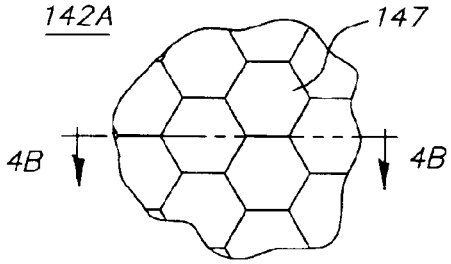
FIGS. 4A–4D are planar and sectional views of two types of anilox roller cavities.
Figure 4C:
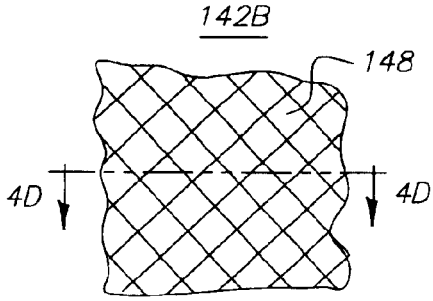
Figure 4B:
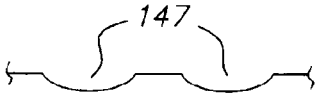
Figure 4D:
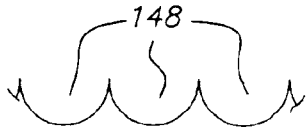

FIG. 4A shows a plan view of a popular cell engraving pattern. There the cells 147 are engraved in a hexagonal pattern at an angle of 60° which gives the roller 104 high strength and good oil release. Note that the cells have a flattened oval cross-sectional profile as shown in FIG. 4B. FIG. 4C shows another popular pattern of square cells 148 that are formed with a laser angle of 45°. Their cross-sectional profile is more circular. Other angles are also suitable including, but not limited to 30°. The dimensions and shapes of the cells are selected to provide the desired metered amounts of release agent. The metered amount of release agent is determined by the volume of the cells and their repetition or frequency rate.

Any suitable laser may be used to form the cells including a standard $CO_2$ laser that is very consistent and offers in operation a good control of oil across the full face of the roll. It also provides a very strong and stable cell structure, which has excellent wear characteristics. With a QED laser, each cell is hit twice by the laser to allow the cell profile to be changed. This provides a fairly high screen count (240 l/cm to 320 l/cm equivalent to 600 l/inch to 800 l/inch) with higher than normal volume. A double hit enables one to cut the cell once and then again to increase the cell depth to achieve the volume required. A YAG laser is the latest solid state laser that runs at a higher frequency, and therefore a higher pulse rate than the $CO_2$ lasers. This enables one to engrave ultra fine screens (320 l/cm to 600 l/cm equivalent to 800 l/inch to 1500 l/inch). A Hy-cell laser has been developed to produce the same cell geometry achieved using the YAG, coupled with the excellent wear resistance of the $CO_2$ generated cells. This extra cell wall hardness will help prevent scoring and marking of the donor roll. A method of manufacturing an anilox roller using a laser is found in U.S. Pat. No. 5,416,298 whose entire disclosure is incorporated by reference.

Those skilled in the art understand that anilox rollers made of metal or carbon fiber may have different cell geometries. Such cell geometries include and are not limited to pyramid cells terminating in an apex, pyramid cells terminating on a flat floor, regular repeating cellular structures, offset repeating cellular structures and V-shaped grooves. Other anilox rollers have patterns that may be used in the invention. Some examples are found in U.S. Pat. Nos. 4,301,730 and 4,603,634, whose entire disclosures are incorporated by reference.

FIG. 2, shows a first preferred embodiment of the invention using a single doctor blade. In the release agent management metering station 100, a donor roller 102 engages the anilox roller 104. The donor roller 102 is made of material with an affinity for the release agent so that the release agent is removed from the cells of the anilox roller. The donor roller removes metered amounts of release agent from the cavities and the anilox roller 104 and carries the release agent to the surface of the fuser roller 62. The release agent management metering station 100 is disposed ahead of the location where the fusing roller 62 fixes the toner material to the receiver sheet 8.

In operation, release agent oil 120 is supplied to the reservoir 110 via the oil supply conduit 106 by oil supply means that are conventional and that are known to those skilled in the art. The level 108 of the oil supply is kept within a predetermined desirable range by the overflow discharge opening 114. During operation of the electrophotographic reproduction apparatus, the anilox metering roller 104 rotates to pass at least a portion of its surface through the release agent oil 120. The metering cavities on the surface of the anilox roller pick up metered amounts of release agent. The doctor blade 112 removes any excess release agent oil from the surface of the anilox roller. The metal doctor blade is typically made of flexible spring steel about 6 to 10 mils thick, with a chamfered edge to facilitate removal. Thereafter, the anilox metering roller 104 transfers the release agent oil 120 to the donor roller 102. The donor roller 102 in turn transfers the release agent oil 120 to the fuser roller 62. The release agent is thus applied to the fuser roller 62 in precise, metered amounts. Thus, excess release agent oil is avoided. The reproduction apparatus 10 then operates efficiently and generates high quality copies. The release agent oil 120 substantially prevents toner particle offset and aids in removing the receiver sheet 8 from the fuser roller 62. The receiver sheets 8 are collected in a discharge hopper 28.

Figure 5A:
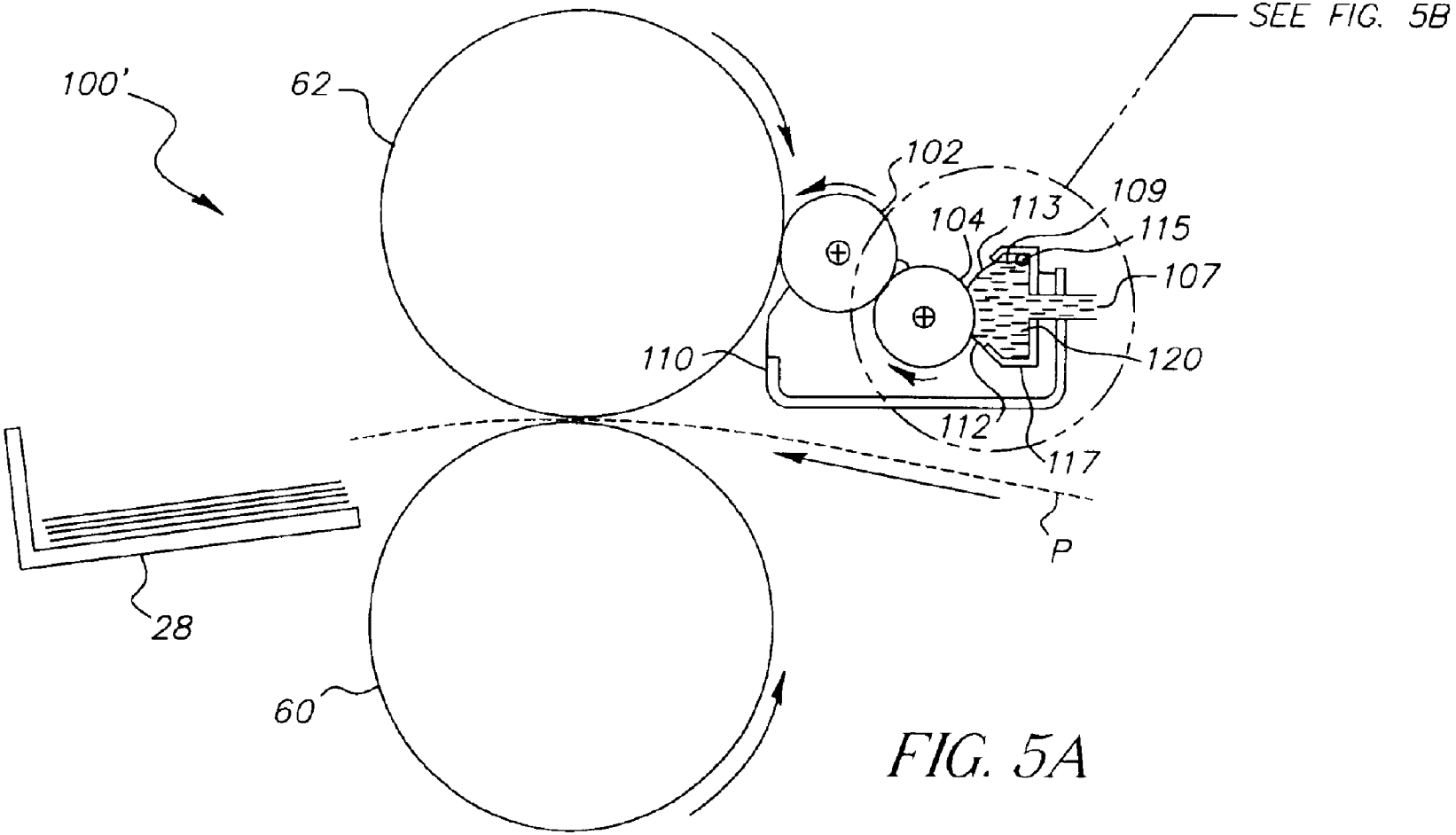
FIG. 5A is a schematic view of a release agent management system with two doctor blades.
Figure 5B:
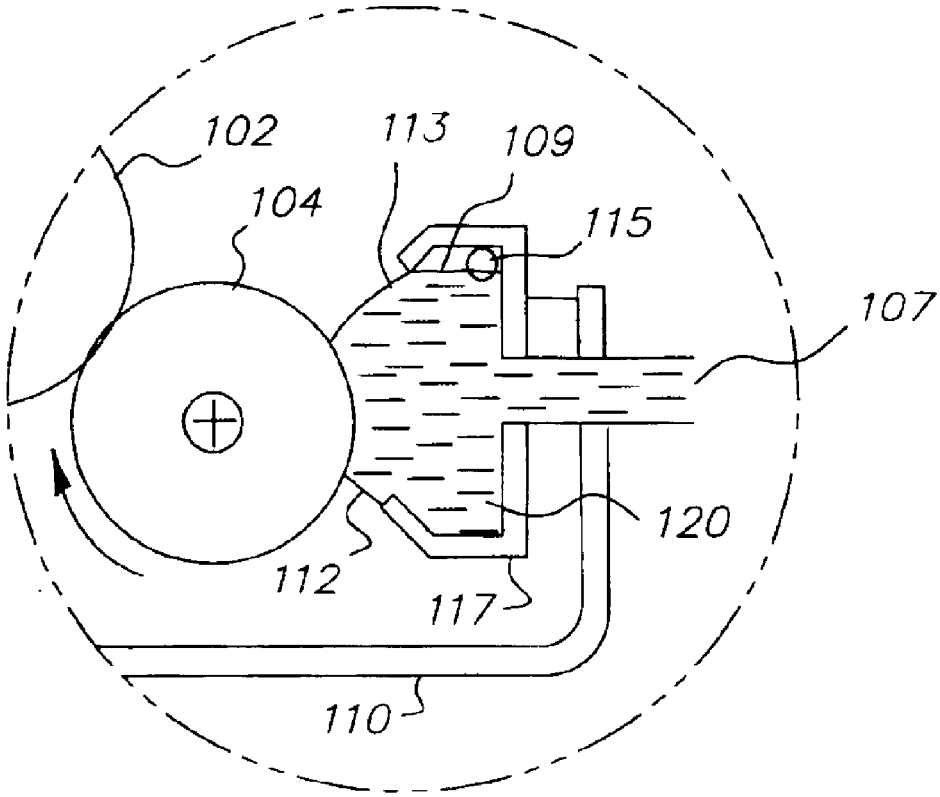
FIG. 5B is a detailed view of the reservoir portion of FIG. 5A.

In another preferred embodiment (See FIGS. 5A and 5B), two doctor blades enclosing a reservoir chamber of release agent are incorporated in the invention. The release agent management system 100 of this other embodiment incorporates a chamber 117 with a release agent supply 107 and a release agent drain or overflow 115. The release agent 120 fills the chamber to the level 109 of the drain 115. Two plastic or metal doctor blades 112, 113 are mounted to the chamber. The connection between the blades 112, 113 and the chamber 117 must be oil tight. The doctor blades 112, 113 are about as long as the metering roller 104 (in the direction of the longitudinal axis), but at least as long as the contact length of the donor roller 102 and the metering roller 104. The ends of the chamber 117 are sealed with pads (not shown) against the metering roller 104. Chamber 117 with the blades 112, 113 and the end pads build together, with the metering roller 104, a substantially oil tight system.

In operation, release agent oil 120 is supplied to the reservoir chamber 117 via the oil supply conduit 107 by oil supply means that are conventional and that are known to those skilled in the art. The level 109 of the oil supply in the chamber 117 is kept within a predetermined desirable range by the overflow discharge opening 115. During operation of the electrophotographic reproduction apparatus, the anilox metering roller 104 rotates to pick up release agent 120 from the closed chamber 117. The metering cavities on the surface of the anilox roller pick up metered amounts of release agent 120. The doctor blades 112 and 113 remove any excess release agent oil and other contaminants from the surface of the anilox roller. The metal doctor blades are typically made of flexible spring steel about 6 to 10 mils thick, with a chamfered edge to facilitate oil removal.

In the nip between the metering roller 104 and the donor roller 102 the release agent 120 transfers from the metering roller 104 to the donor roller 102 to a certain percentage. This percentage depends on the split factor between the two rollers; it is typically 50%. In the nip between the fuser roller 62 and the donor roller 102 the release agent 120 then transfers to the fuser roller 62, again according to the split factor between the two rollers.

The advantage of the second embodiment is that the release agent resides in a closed system. The amount of contamination which can get into the release agent is very limited. Contamination on the metering roller surface gets skived off by one of the blades, depending on the direction of rotation of the roller.

Those skilled in the art will understand that further additions, deletions and modifications of this invention may be made to form equivalent apparatus and methods that are within the spirit and scope of the claims.

PARTS LIST

8 receiver sheet
10 reproduction apparatus
12 charge retentive dielectric member
14 charging station
18 developing station
20 transfer station
22 supply hopper
24 detach mechanism
26 fusing device
30 cleaning station
60 support roller
62 fuser roller
100 meter station
102 donor roller
104 anilox metering roller
106 oil supply conduit
107 oil supply conduit
108 level of release oil
109 level of release oil
110 reservoir
112 doctor blade
113 second doctor blade
114 oil discharging opening
115 oil discharging opening
116 blade holder
117 reservoir chamber
140 sleeve
142 ceramic sleeve
143 aluminum sleeve
144 polymer layer
145 compressible membrane
146 composite inner sleeve
147 hex cells
148 square cells

What is claimed is:

1. For use with a reproduction apparatus with process stations for forming a toner particle image on a receiver sheet and fusing said image to said receiver sheet, wherein the fusing station includes a fuser roller heated to a sufficient temperature to fuse toner to the receiver sheet, and a release agent metering station to apply a release oil to said fuser roller to substantially prevent toner particle offset thereto, said release agent metering station comprising:

a reservoir for holding a supply of release agent material;

an anilox roller, associated with said reservoir, having a surface with a plurality of metering cavities, on the order of 400 cavities per inch to 1200 cavities per inch, for holding metered amounts of release agent material from said reservoir; and a donor member disposed in contact with said anilox roller and the fuser roller for transferring said metered amounts of release agent from said anilox roller to the fuser roller.

2. The release agent metering station of claim 1, wherein the donor member comprises a donor roller engaged with the fuser roller and with said anilox roller, said donor roller receiving metered amounts of release agent material from said anilox roller and transferring said metered amounts of release agent to the fuser roller.

3. The release agent metering station of claim 1, wherein the release agent material is liquid.

4. The release agent metering station of claim 2, further comprising a first doctor blade engaging the surface of said anilox roller to remove excess release agent material from said surface before said surface contacts said donor roller.

5. The release agent metering station of claim 4, wherein said first doctor blade is oriented in a direction opposing travel of said anilox roller.

6. The release agent metering station of claim 4, wherein a portion of said anilox roller is immersed in the release agent material in said reservoir.

7. The release agent metering station of claim 5, further comprising a second doctor blade oriented in the direction of travel of said anilox roller.

8. The release agent metering station of claim 7, further comprising a pad at each end of the reservoir.

9. The release agent metering station of claim 8, wherein said doctor blades, said anilox roller, and said pads enclose said reservoir.

10. The release agent metering station of claim 1, further comprising a conduit for supplying release agent material to the reservoir and an overflow port in the reservoir for discharging release agent material when the level of the release agent material exceeds a predetermined maximum level.

* * * * *